US008235217B2

(12) United States Patent
Stolzman

(10) Patent No.: US 8,235,217 B2
(45) Date of Patent: Aug. 7, 2012

(54) BULK CONTAINER WITH CAP AND PALLET BASE

(76) Inventor: Michael D. Stolzman, Lake Forest, IL (US)

( * ) Notice: Subject to any disclaimer, the term of this patent is extended or adjusted under 35 U.S.C. 154(b) by 2154 days.

(21) Appl. No.: 11/135,927

(22) Filed: May 24, 2005

(65) Prior Publication Data

US 2006/0266747 A1 Nov. 30, 2006

(51) Int. Cl.
*B65D 19/00* (2006.01)

(52) U.S. Cl. ..... 206/600; 206/503; 220/4.26; 220/4.28

(58) Field of Classification Search ..... 206/386, 206/595–600, 499, 503–513; 220/1.5, 4.26, 220/4.28, 4.31, 4.33, 4.34, 6–8
See application file for complete search history.

(56) References Cited

U.S. PATENT DOCUMENTS 1,139,536 A * 5/1915 Klenk ..... 220/620
4,050,604 A * 9/1977 Flanders ..... 220/4.28
4,392,606 A * 7/1983 Fremion ..... 206/600
4,550,830 A * 11/1985 Shuert ..... 206/386
4,643,314 A * 2/1987 Kidd ..... 206/600
4,673,087 A * 6/1987 Webb ..... 206/600
4,676,373 A * 6/1987 Schneider ..... 206/386
4,765,252 A * 8/1988 Shuert ..... 108/55.1
4,785,957 A * 11/1988 Beck et al. ..... 220/4.28
4,809,851 A * 3/1989 Oestreich et al. ..... 206/599
4,936,451 A * 6/1990 Shuert ..... 206/386
4,969,567 A * 11/1990 Rogers ..... 220/4.33
5,056,666 A * 10/1991 Janssens ..... 206/600
5,109,985 A * 5/1992 Rose ..... 206/600
5,133,460 A * 7/1992 Shuert ..... 206/600
5,204,149 A * 4/1993 Phenicie et al. ..... 428/57
5,251,753 A * 10/1993 Pigott et al. ..... 206/766
5,279,423 A * 1/1994 Shuert ..... 206/600
5,356,014 A * 10/1994 Berner ..... 206/600
5,441,154 A * 8/1995 Youell, III ..... 206/599
5,450,681 A * 9/1995 Stolzman ..... 40/308
5,458,069 A 10/1995 Stolzman
5,474,196 A * 12/1995 Fausel et al. ..... 220/4.28
5,487,471 A * 1/1996 Marchek et al. ..... 206/725
5,555,980 A * 9/1996 Johnston et al. ..... 206/600
5,558,241 A * 9/1996 Huffstutler et al. ..... 220/1.5
5,558,242 A * 9/1996 Kuan ..... 220/4.31
5,564,599 A * 10/1996 Barber et al. ..... 222/105
5,566,849 A * 10/1996 Goehner ..... 220/7
5,601,202 A * 2/1997 Meacham et al. ..... 220/6
5,609,111 A * 3/1997 Hasegawa et al. ..... 108/55.1
5,722,551 A * 3/1998 Cocciemiglio, Jr. ..... 220/4.33
5,743,422 A * 4/1998 Hale ..... 220/4.33
5,794,542 A * 8/1998 Besaw ..... 108/51.3
5,797,508 A * 8/1998 Loftus et al. ..... 220/6
5,799,812 A * 9/1998 Mansouri ..... 220/4.31
5,826,721 A * 10/1998 Fujimoto et al. ..... 206/389
5,829,595 A * 11/1998 Brown et al. ..... 206/600

(Continued)

*Primary Examiner* — J. Gregory Pickett
*Assistant Examiner* — Ned A Walker
(74) *Attorney, Agent, or Firm* — Wood, Phillips, Katz, Clark & Mortimer

(57) ABSTRACT

A bulk container comprises a one piece base, a cap and a peripheral side wall. The base includes a generally rectangular bottom wall, a plurality of longitudinal rails extending below the bottom wall, and a peripheral wall extending upwardly from the bottom wall. The peripheral wall defines an upwardly opening channel. The cap includes an inner wall connected to an outer wall defining a downwardly opening channel complimentary with the upwardly opening channel. The peripheral side wall is received in the upwardly opening channel and the downwardly opening channel to define a parallelepiped interior space.

20 Claims, 5 Drawing Sheets

U.S. PATENT DOCUMENTS 5,836,255 A * 11/1998 Uitz ..... 108/57.25
6,021,916 A 2/2000 Stolzman
6,155,181 A * 12/2000 Chilcutt ..... 108/51.3
6,161,715 A 12/2000 Stolzman
6,189,695 B1 * 2/2001 Ching-rong ..... 206/509
6,266,972 B1 * 7/2001 Bostic ..... 62/371
6,389,990 B1 * 5/2002 Apps ..... 108/57.25
6,401,952 B1 * 6/2002 Ming ..... 220/4.09
6,668,735 B2 * 12/2003 Cassina ..... 108/57.25
6,827,231 B2 * 12/2004 Budowski et al. ..... 220/4.29
6,966,449 B2 * 11/2005 Williams ..... 220/4.31
7,287,661 B2 * 10/2007 Knutsson et al. ..... 220/7
2003/0106894 A1 * 6/2003 Budowski et al. ..... 220/4.28

* cited by examiner

FIG. 1
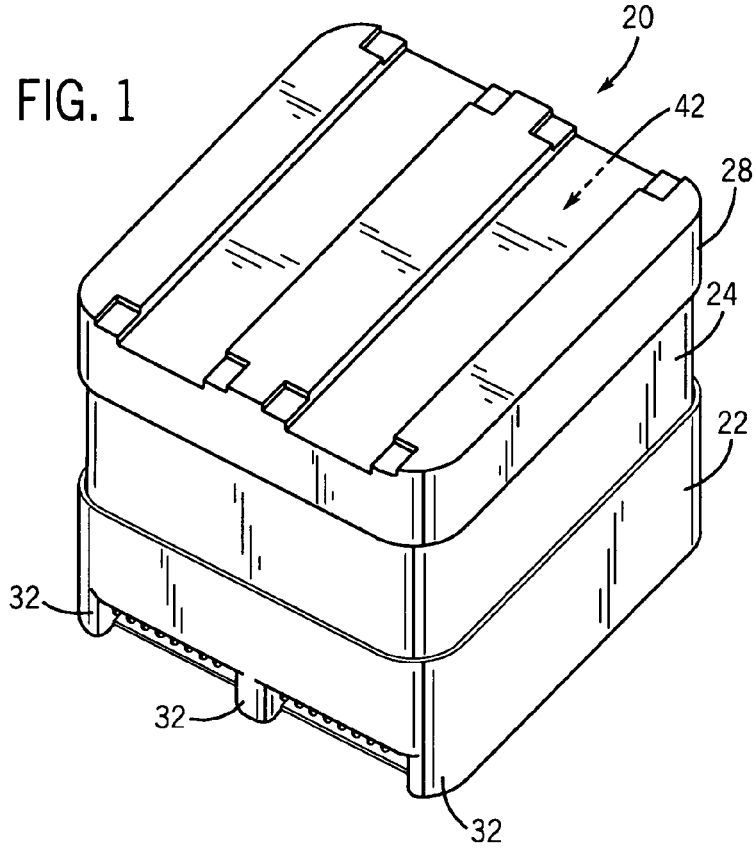
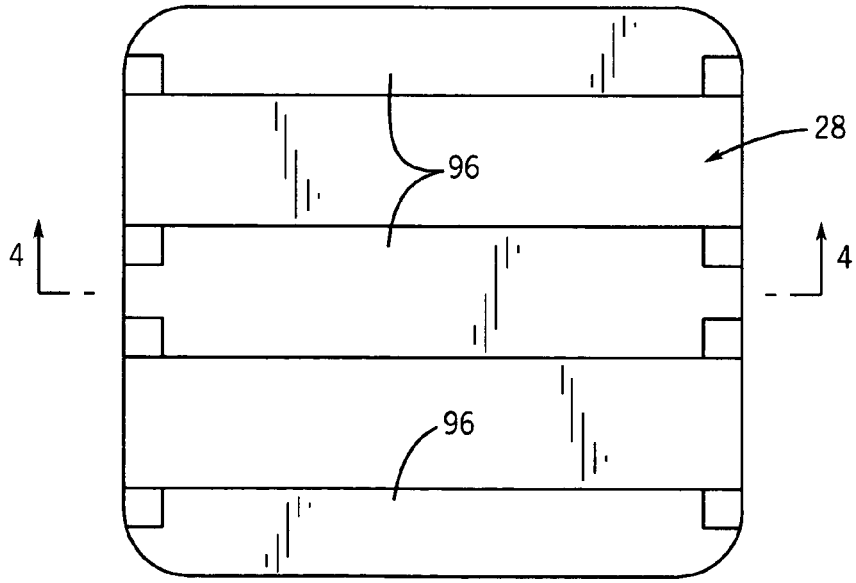
FIG. 3

FIG. 7
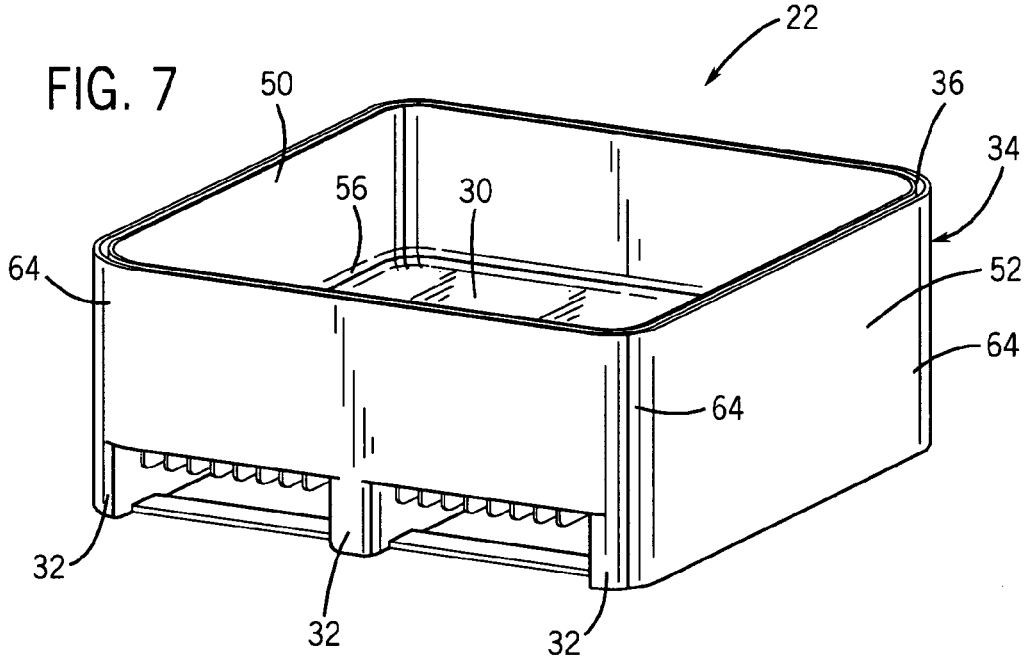
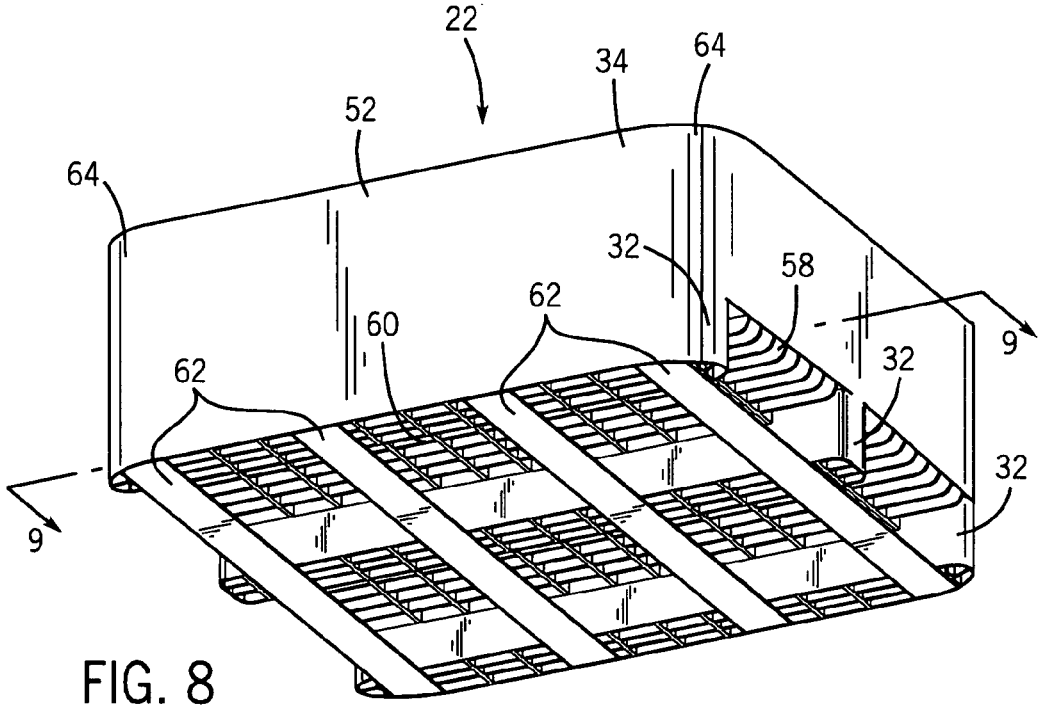
FIG. 8

FIG. 9
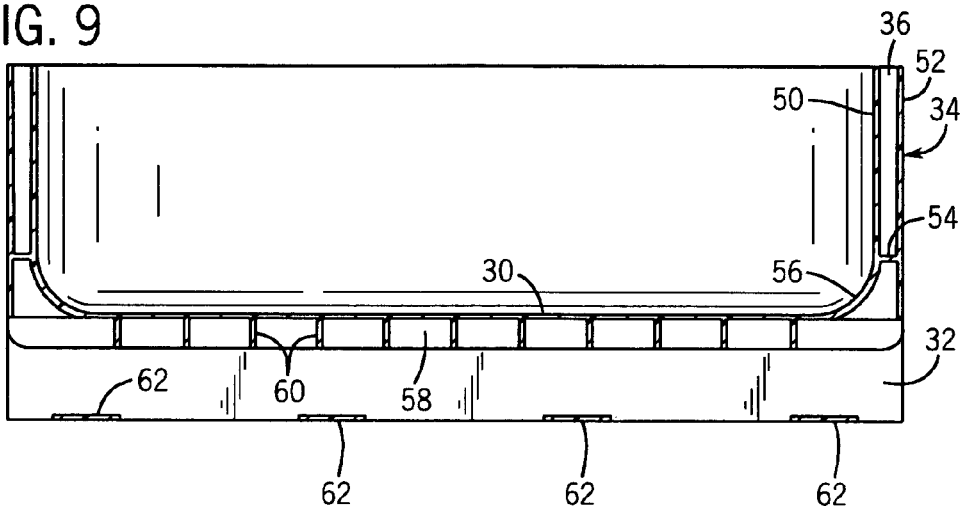
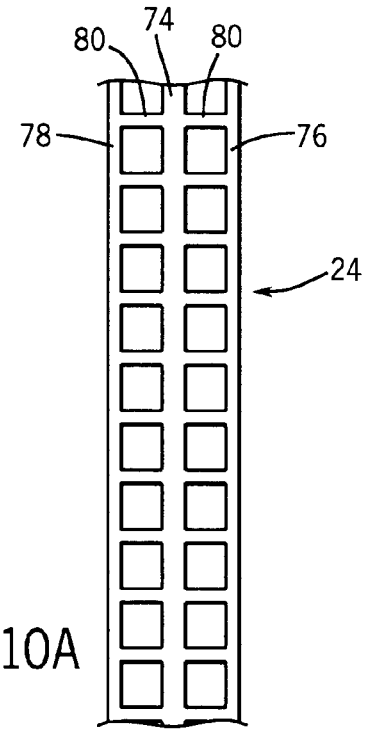
FIG. 10A
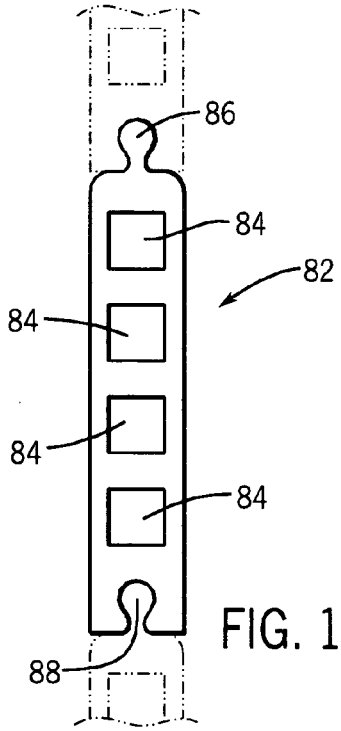
FIG. 10B
FIG. 11
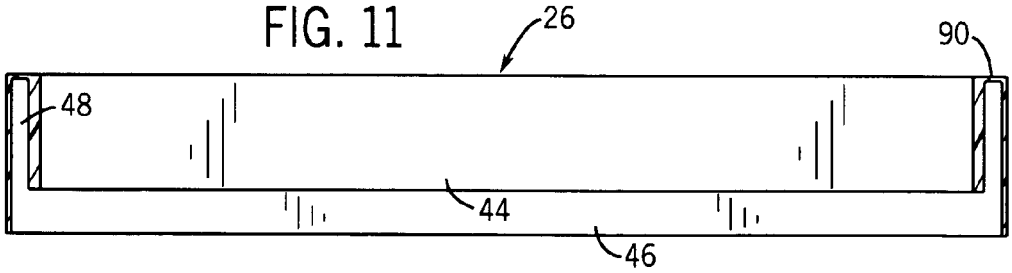

BULK CONTAINER WITH CAP AND PALLET BASE

FIELD OF THE INVENTION

This invention relates to a bulk container and, more particularly, to a collapsible, non-wood bulk container.

BACKGROUND OF THE INVENTION

A bulk container, such as a pallet bin, is used to store and ship goods of liquid, solid, and granular materials. A typical pallet bin is constructed of plywood panels with a built-in pallet base. The pallet bin is generally of all wood construction including a wood bottom panel screwed or nailed to a conventional wooden pallet. Plywood side and end panels are held together using corner angle and placed atop the bottom panel and are secured using retaining brackets. A plywood top can be placed atop the side and end panels. A plastic liner is placed inside the bin to prevent the product from coming into direct contact with the wood panels. Such a bin typically has a three hundred gallon capacity.

In use, a large plastic aseptic bag is placed in the bin and sealed. The bag may include a food product such as a puree from fruits or vegetables. The bin acts as a skeleton to transport the processed food. When the bag is empty it is thrown away. Typically, the pallet bins are collapsible as by breaking down the top cover and the side and end walls and stacking them on the bottom panel. The bin can then be shipped back to the supplier. Such use typically also requires use of banding for supporting the wood panels. Without the banding, the wood panels might not hold the product. Also, wood splinters and improperly placed nails can destroy the bags. Moreover, after repeated nailing, the wood panels become weaker and therefore must be disposed of. This contributes to the escalating problem of waste disposal.

More recently, pallet bins have been constructed principally of plastic. These bins typically utilize interlocking structure for holding the various components together. However, due to the need for strength, while limiting weight, plastic pallet bins typically incorporate structures having numerous voids. However, dirt, insects and rodents could gather in such voids. This could render the products undesirable for use in the food industry.

The present invention is directed to overcoming one or more of the problems discussed above in a novel and simple manner.

SUMMARY OF THE INVENTION

In accordance with the invention, there is provided a bulk container of non-wood construction.

In accordance with one aspect of the invention, there is disclosed a bulk container comprising a one piece base, a cap and a peripheral side wall. The base includes a generally rectangular bottom wall, a plurality of longitudinal rails extending below the bottom wall, and a peripheral wall extending upwardly from the bottom wall. The peripheral wall defines an upwardly opening channel. The cap includes an inner wall connected to an outer wall defining a downwardly opening channel complimentary with the upwardly opening channel. The peripheral side wall is received in the upwardly opening channel and the downwardly opening channel to define a parallelepiped interior space.

It is a feature of the invention that the base peripheral wall comprises a double wall including an inner wall portion and an outer wall portion defining the upwardly opening channel.

The base inner wall portion may be connected to the bottom wall periphery by a curved wall portion to provide a smooth transition from the bottom wall to the inner wall portion.

It is another feature of the invention that the base includes a network of reinforcing ribs extending downwardly from the bottom wall.

It is a further feature of the invention that the base is of one piece plastic construction.

It is another feature of the invention to provide a removable cover receivable on the cap. The cover may comprise longitudinally extending raised wall portions for supporting rails of a base for stacking bulk containers.

It is another feature of the invention that the peripheral side wall comprises a corrugated wall.

It is still another feature of the invention that the peripheral side wall comprises interlocking wall elements.

It is still another feature of the invention that the interior space has a volume of about 300 gallons.

There is disclosed in accordance with another aspect of the invention, a bulk container comprising a one piece plastic base including a generally rectangular bottom wall. A plurality of longitudinal rails extend below the bottom wall. A peripheral wall extends upwardly from the bottom wall. The peripheral wall defines an upwardly opening channel. A peripheral side wall includes a bottom end and a top end. The bottom end is received in the upwardly opening channel to define a parallelepiped interior space. A cap includes an inner wall connected to an outer wall defining a downwardly opening channel receiving a top end of the peripheral side wall. The base peripheral wall and the cap reinforce the bottom and top ends of the peripheral side wall. A removable cover is receivable on the cap to close the interior space.

Further features and advantages of the invention will be readily apparent from the specification and from the drawings.

BRIEF DESCRIPTION OF THE DRAWINGS

FIG. 1 is a perspective view of a bulk container in accordance with the invention;

FIG. 3 is a top plan view of the bulk container of FIG. 1;

FIG. 7 is a perspective view of a one piece base of the bulk container of FIG. 1;

FIG. 8 is a bottom perspective view of the base of FIG. 7;

FIG. 9 is a sectional view of the base of FIG. 7;

FIG. 10A is a cut away view of a section of a peripheral side wall of the bulk container of FIG. 1 according to one embodiment of the invention;

FIG. 10B is a top view of a section of an alternative peripheral side wall design; and FIG. 11 is a sectional view of a cap of the bulk container of FIG. 1.

DETAILED DESCRIPTION OF THE INVENTION

Figure 2:
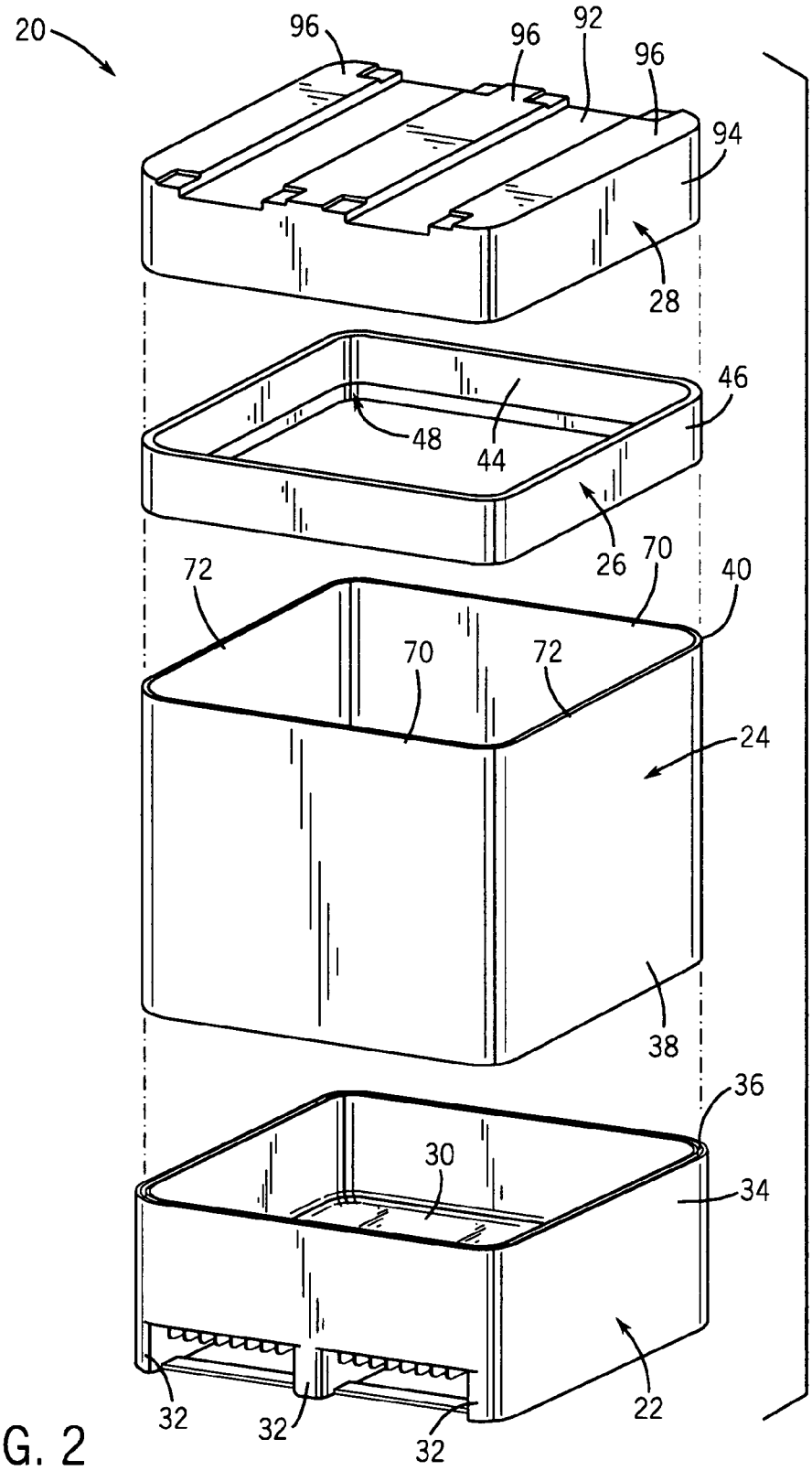
FIG. 2 is an exploded perspective view of the bulk container of FIG. 1.

Referring initially to FIGS. 1 and 2, a bulk container in the form of a pallet bin 20 according to the invention is illustrated. The bulk container 20 includes a one piece plastic base 22, a peripheral side wall 24, a one piece plastic cap 26 and a one piece plastic removable cover 28. The base 22 includes a generally rectangular bottom wall 30, a plurality of longitudinal rails or legs 32 extending below the bottom wall 30 and a peripheral wall 34 extending upwardly from the bottom wall 30. The peripheral wall defines an upwardly opening channel 36. The peripheral side wall 24 includes a bottom end 38 and a top end 40. The bottom end 38 is received in the upwardly opening channel 36 to define a parallelepiped interior space 42. The cap 26 includes an inner wall 44 connected to an outer wall 46 to define a downwardly opening channel 48 complementary with the upwardly opening channel 36 and received on the top end 40 of the peripheral side wall 24. The base peripheral wall 34 and the cap 26 reinforce the bottom and top ends 38 and 40 of the peripheral side wall 24. The removable cover 28 is receivable on the cap 26 to close the interior space 42, as shown in FIG. 1.

Referring also to FIGS. 7, 8 and 9, the base 22 is of one piece plastic construction. The base 22 may be formed, for example, by injection molding. The wall thickness is generally about 0.25" throughout. The peripheral wall 34 comprises a double wall structure including an inner wall portion 50 and an outer wall portion 52 to define the upwardly opening channel 36. A connecting portion 54 connects the inner wall portion 50 and the outer wall portion 52 above the bottom wall 30 to define a bottom of the channel 36 and to provide a stop for the peripheral side wall 24. The outer wall portion 52 is flush with the outermost rails 32. A curved wall portion 56 connects the inner wall portion 50 to the bottom wall 30 to provide a smooth transition from the bottom wall 30 to the inner wall portion 50. The curved wall portion 56 and a bottom of the inner wall portion 50 may be of greater wall thickness, such as on the order of 0.42" for added strength. A network of longitudinally extending reinforcing ribs 58 and transversely extending reinforcing ribs 60 depend downwardly from the bottom wall 30 to provide rigidity. A plurality of runners 62 are integrally connected to bottoms of the rails 32 and are engageable with a support surface on which the container 10 is positioned.

In an illustrative embodiment of the invention, the base 22 has an overall height of about 18" and an interior height above the bottom wall 30 of about 12.5". The base is about 48" longitudinally, i.e., in the direction of the rails 32, and about 44" wide. Advantageously, the base 22 includes rounded corners 64.

Referring particularly to FIG. 2, the peripheral side wall 24 includes laterally extending walls 70 connected between longitudinally extending walls 72. In one embodiment of the invention, the peripheral side wall 24 may be of one piece construction and may be of a corrugated material, such as shown in FIG. 10A, including a central wall 74 connected between outside walls 76 and 78 by transverse connecting portions 80. In this embodiment, the side wall 24 may be formed of a fiber material, or could be formed of plastic or an engineering resin. Alternatively, and with reference to FIG. 10B, the peripheral side wall 24 could be formed by a plurality of interlocking extrusions 82, such as of aluminum, having elongate openings 84 and a rounded dovetail 86 at one end and a rounded dovetail groove 88 at another end extending longitudinally. In this embodiment, a plurality of extrusions are interlocked to form the configuration illustrated in FIG. 2. The type of material used and the design type could depend on whether the side wall 24 is intended to be a disposable item or reusable.

In an illustrative embodiment of the invention, the peripheral side wall 24 has a height of about 34" and has wall length sized to be received in the base upwardly opening channel 36 and the cap downwardly opening channel 48.

With reference also to FIG. 11, the cap 26 is of one piece plastic construction and may be formed also by injection molding. The outer wall 46 is connected to the inner wall 44 by a top connecting portion 90. The outer wall 46 may be longer than the inner wall 44. In an illustrative embodiment of the invention, the cap 26 has a wall thickness on the order of 0.25" or may be thicker, in the order of 0.37". In one embodiment, the inner wall thickness is greater than the outer wall thickness. In an illustrative embodiment of the invention, the inner wall 44 is about 5" in height and the outer wall 46 is about 7" in height.

Figure 5:
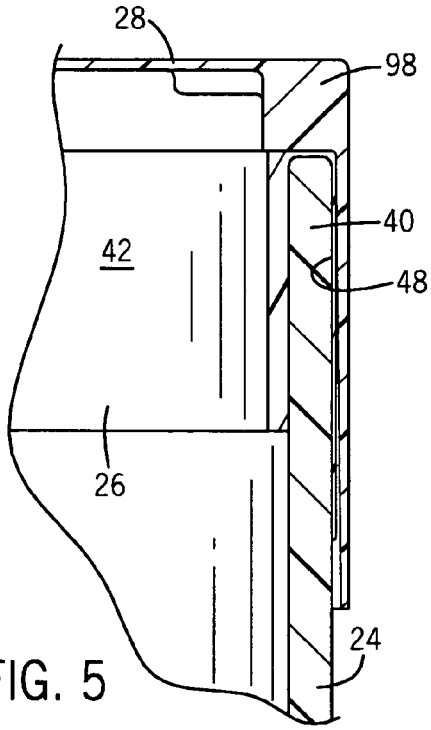
FIG. 5 is a detailed view of an upper right corner of the section of FIG. 4.
Figure 6:
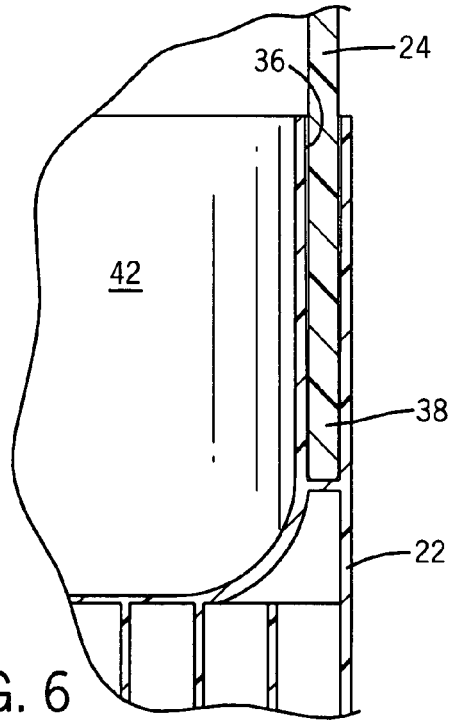
FIG. 6 is a detailed view of the lower right area of the section of FIG. 4.

Referring again to FIG. 2, the cover 28 is of one piece molded plastic construction and includes a top wall 92 and connected to a peripheral wall 94. The peripheral wall 94 is sized to be telescopically received on the cap 46. The peripheral wall 94 has an internal height of about 8.5". The top wall 92 has longitudinally extending raised wall portions 96 along its edges and centrally therebetween. The raised portions 96 are adapted to receive the rails 32 of a base 22 for stacking. The overall height of the cover 28 in an illustrative embodiment of the invention is about 10". The upper longitudinally extending edges 98 are of greater wall thickness, as shown in FIG. 5, to act like a beam so that for stacking the weight is distributed downwardly along the longitudinal side. The inner height of the peripheral wall 94 being greater than the height of the cap 26 results in the cover 28 covering and concealing the cap 26, as particularly illustrated in FIG. 5.

Figure 4:
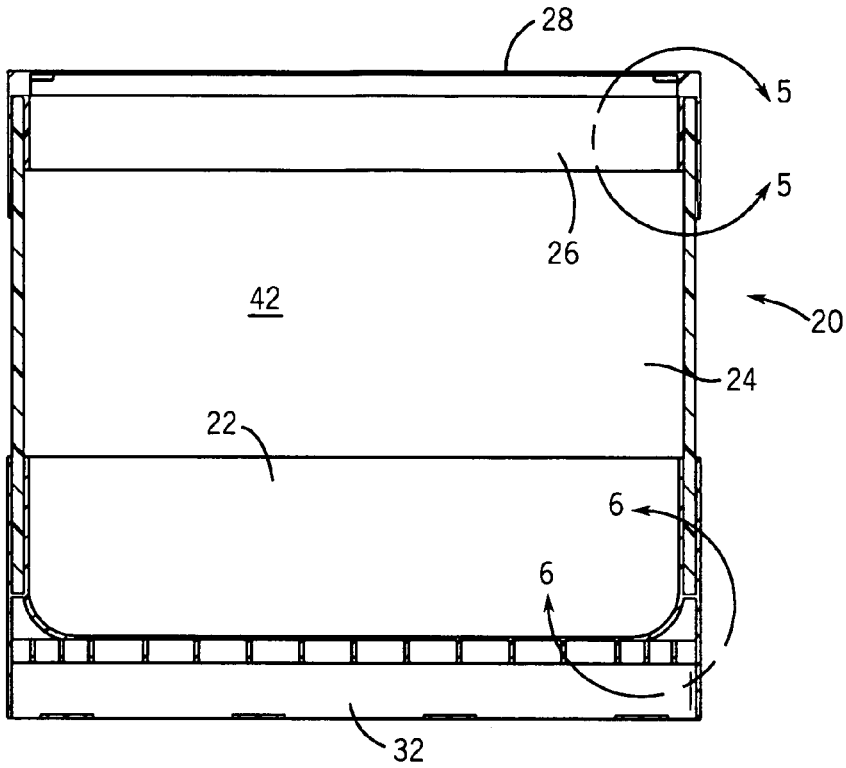
FIG. 4 is a sectional view taken along the line 4-4 of FIG. 3.

In use, the base 22 is positioned on a suitable support surface. The peripheral side wall bottom end 38 is inserted into the base upwardly opening channel 36. Thereafter, the cap 26 is positioned so that the downwardly opening channel 48 is received on the peripheral side wall top end 40. An aseptic bag, or the like, (not shown) can then be inserted in the space 42 and filled with appropriate material to be stored or transported. The removable cover 28 is then placed over the cap 26 to close the space 42, as shown in FIGS. 1 and 4. The double wall structure of the peripheral wall 34 reinforces the peripheral side wall bottom end 38 to prevent bulging. Likewise, the cap 26 reinforces the peripheral side wall top end 40. This permits use of a lower cost or even disposable peripheral side wall 24. When not in use, the peripheral side wall 24 may be folded flat and inserted in the base 22 with the cap and cover then placed atop the base to take up less room when not in use. The overall height of the bulk container 10 is on the order of 48" and provides a capacity of about 300 gallons. The bulk container 10 eliminates the use of wood and the primary components, the base 22, cap 26 and cover 28 are of plastic construction. The peripheral side wall 24 can also be of plastic construction or aluminum, or fiber, or the like. None of the components are of wood construction.

Thus, in accordance with the invention, there is illustrated and described a bulk container primarily of plastic construction.

I claim:

1. A bulk container comprising:

a one piece base including a generally rectangular bottom wall, a plurality of longitudinal rails extending below the bottom wall, and a peripheral wall extending upwardly from the bottom wall, the peripheral wall defining an upwardly opening channel;

a cap including an inner wall connected to an outer wall defining a downwardly opening channel complementary with the upwardly opening channel; and a peripheral side wall received in the upwardly opening channel and the downwardly opening channel to define a parallelepiped interior space.

2. The bulk container of claim 1 wherein the base includes a network of reinforcing ribs extending downwardly from the bottom wall.

3. The bulk container of claim 1 wherein the base is of one piece plastic construction.

4. The bulk container of claim 1 wherein the peripheral side wall comprises a corrugated wall.

5. The bulk container of claim 1 wherein the peripheral side wall comprises interlocking wall elements.

6. The bulk container of claim 1 wherein the interior space has a volume of about 300 gallons.

7. The bulk container of claim 1 wherein the base peripheral wall comprises a double wall including an inner wall portion and an outer wall portion defining the upwardly opening channel.

8. The bulk container of claim 7 wherein the base inner wall portion is connected to the bottom wall periphery by a curved wall portion to provide a smooth transition from the bottom wall to the inner wall portion.

9. The bulk container of claim 1 further comprising a removable cover receivable on the cap.

10. The bulk container of claim 9 wherein the cover comprises longitudinally extending raised wall portions for supporting rails of a base for stacking bulk containers.

11. A bulk container comprising:

a one piece plastic base including a generally rectangular bottom wall, a plurality of longitudinal rails extending below the bottom wall, and a peripheral wall extending upwardly from the bottom wall, the peripheral wall defining an upwardly opening channel;

a peripheral side wall including a bottom end and a top end, the bottom end received in the upwardly opening channel to define a parallelepiped interior space;

a cap including an inner wall connected to an outer wall defining a downwardly opening channel receiving the top end of the peripheral side wall, the base peripheral wall and the cap reinforcing the bottom and top ends of the peripheral side wall; and a removable cover receivable on the cap to close the interior space.

12. The bulk container of claim 11 wherein the base includes a network of reinforcing ribs extending downwardly from the bottom wall.

13. The bulk container of claim 11 wherein the base is of one piece plastic construction.

14. The bulk container of claim 11 wherein the cover is of one piece plastic construction.

15. The bulk container of claim 11 wherein the cover comprises longitudinally extending raised wall portions for supporting rails of a base for stacking bulk containers.

16. The bulk container of claim 11 wherein the peripheral side wall comprises a corrugated wall.

17. The bulk container of claim 11 wherein the peripheral side wall comprises interlocking wall elements.

18. The bulk container of claim 11 wherein the interior space has a volume of about 300 gallons.

19. The bulk container of claim 11 wherein the base peripheral wall comprises a double wall including an inner wall portion and an outer wall portion defining the upwardly opening channel.

20. The bulk container of claim 19 wherein the base inner wall portion is connected to the bottom wall periphery by a curved wall portion to provide a smooth transition from the bottom wall to the inner wall portion.

* * * * *